US008092087B2

(12) United States Patent
Simhony et al.

(10) Patent No.: US 8,092,087 B2
(45) Date of Patent: Jan. 10, 2012

(54) BAG WITH ADJUSTABLE STRAP ADAPTED TO BE CARRIED ON SHOULDERS OR BACK

(75) Inventors: Orly Simhony, Caesarea (IL); Ilanit Saranga, Herzelia (IL)

(73) Assignee: Triboro Quilt Manufacturing Corporation, White Plains, NY (US)

( * ) Notice: Subject to any disclaimer, the term of this patent is extended or adjusted under 35 U.S.C. 154(b) by 274 days.

(21) Appl. No.: 12/584,206

(22) Filed: Sep. 1, 2009

(65) Prior Publication Data

US 2010/0092110 A1 Apr. 15, 2010

(51) Int. Cl.

| | |
|---|---|
| ***B65D 33/06*** | (2006.01) |
| ***B65D 33/14*** | (2006.01) |
| ***B65D 30/22*** | (2006.01) |
| ***A45C 13/26*** | (2006.01) |
| ***A45C 1/02*** | (2006.01) |
| ***A45C 15/00*** | (2006.01) |
| ***A45C 13/03*** | (2006.01) |
| ***A45F 4/00*** | (2006.01) |
| ***A45F 3/00*** | (2006.01) |
| ***A45F 3/02*** | (2006.01) |

(52) U.S. Cl. ..... 383/25; 383/22; 383/26; 383/38; 383/40; 150/108; 150/112; 224/578; 224/603; 224/604; 224/606

(58) Field of Classification Search ..... 383/13, 383/2, 4, 25, 26, 27, 22, 38, 40; 150/107, 150/108, 110, 112, 117; 224/606, 603, 604, 224/578

See application file for complete search history.

(56) References Cited

U.S. PATENT DOCUMENTS

| | | | | |
|---|---|---|---|---|
| 432,607 | A * | 7/1890 | Dwyer | 224/153 |
| 3,346,155 | A * | 10/1967 | Oechsle | 294/141 |
| 3,802,613 | A * | 4/1974 | Droeger | 224/153 |
| 4,240,480 | A * | 12/1980 | Strobel | 383/15 |
| 4,273,274 | A * | 6/1981 | Freistadt | 294/141 |
| 4,679,671 | A * | 7/1987 | Kobayashi | 190/115 |
| 5,653,337 | A * | 8/1997 | Cirigliano | 206/373 |
| 6,257,472 | B1 * | 7/2001 | Freedman | 224/614 |
| 6,471,105 | B1 * | 10/2002 | Ammerman et al. | 224/625 |
| 7,073,942 | B2 * | 7/2006 | Vazquez | 383/2 |
| 7,160,028 | B1 * | 1/2007 | Linday | 383/4 |

FOREIGN PATENT DOCUMENTS

| | | | |
|---|---|---|---|
| DE | 10055165 | A1 * | 6/2002 |
| EP | 1044602 | A1 * | 10/2000 |
| JP | 2008279186 | A * | 11/2008 |

* cited by examiner

*Primary Examiner* — Jes F Pascua

(74) *Attorney, Agent, or Firm* — McDermott Will & Emery LLP

(57) ABSTRACT

A bag with an adjustable strap configured for a holding the bag in a variety of different positions. The bag includes a bag body having a bottom, a front side, a back side and an opening opposite the bottom. The bag body includes two primary fasteners on the back side in the vicinity of the opening. An adjustable strap with two ends is fixed at both ends to the back side of the bag body in the vicinity of the bottom. The adjustable strap includes two end sections adjacent the ends, two extension sections adjacent the end sections and a middle section between the extension sections. A first secondary fastener is disposed between the end sections and extension sections and a second secondary fastener is disposed between the extension sections and middle section. The first secondary fasteners are configured to attach to the primary fasteners such that the middle section and extension sections form a long shoulder strap between the primary fasteners. The two second secondary fasteners are configured to attach to the primary fasteners of the bag body such that each extension section and adjacent end section form a backpack strap.

11 Claims, 9 Drawing Sheets

BAG WITH ADJUSTABLE STRAP ADAPTED TO BE CARRIED ON SHOULDERS OR BACK

FIELD OF THE INVENTION

The present invention relates to a bag with an adjustable strap and, in particular, a bag with an adjustable strap that can be carried in a variety of different positions.

BACKGROUND OF THE INVENTION

There is demand among the general public for a bag that can be carried in a variety of different positions, such as a shoulder bag over one shoulder and on the back as a backpack. Depending on a person's activity, destination or the things that they are carrying, the person may want to have a variety of different bags for each of those situations. However, if the person's activity, destination or load change while they are away from home, they are unlikely to have a more appropriate bag with them to accommodate the new activity, destination or load. For example, if a person is away from home and are carrying only a few things, they may prefer to have a shoulder bag. However, if they receive gifts or buy things and the weight of their load increases, they may prefer to carry the bag on both shoulders as a backpack. Thus, a bag which is adjustable and can adapt to a variety of different positions would be convenient.

The present invention provides a bag that is designed to enable the user to carry the bag in a variety of different manners, including as a shoulder bag and as a backpack.

SUMMARY OF THE INVENTION

In an embodiment, the present invention provides a bag with a bag body having a bottom, a front side, a back side and an opening opposite the bottom. The bag body includes two primary fasteners on the back side in the vicinity of the opening. An adjustable strap with two ends is fixed at both ends to the back side of the bag body in the vicinity of the bottom. The adjustable strap includes two end sections adjacent the ends, two extension sections adjacent the end sections and a middle section between the extension sections. A first secondary fastener is disposed between each end section and adjacent extension section. A second secondary fastener is disposed between each extension section and the middle section. The two first secondary fasteners are configured to attach to the primary fasteners of the bag body such that the middle section and extension sections form a long shoulder strap between the primary fasteners. The two second secondary fasteners are configured to attach to the primary fasteners of the bag body such that each extension section and adjacent end section form a backpack strap. Accordingly, the bag can be used as a shoulder bag by attaching the first secondary fasteners of the adjustable strap to the primary fasteners of the bag body or the bag can be used as a backpack by attaching the second secondary fasteners of the strap to the primary fasteners.

BRIEF DESCRIPTION OF THE DRAWINGS

The foregoing and other features of the present invention will be more readily apparent from the following detailed description and drawings of illustrative embodiments of the invention in which.

DETAILED DESCRIPTION OF PREFERRED EMBODIMENTS

Figure 1:
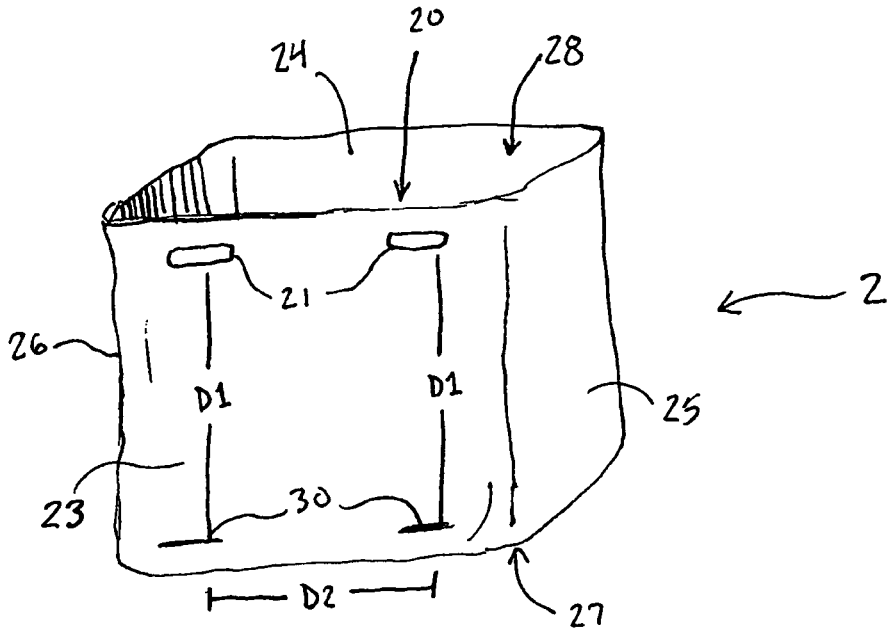
FIG. 1 is a back perspective view of a bag body in accordance with an embodiment of the invention.

FIG. 1 shows a bag body 2 of a bag 1 (shown in FIG. 4) in accordance with an embodiment of the present invention. The bag body 2 includes an inside 20 surrounded by a back side 23, a front side 24, a left side 25, a right side 26, a bottom 27. An opening 28 opposite the bottom 27 provides access to the inside 20. Two slots 21 are included in the back side 23 of the bag body in the vicinity of the opening 28. Preferably, the slots 21 are substantially the same distance from the opening 28 and are respectively disposed near the left and right sides 25, 26 of the bag body 2. In line with the slots 21 in the vicinity of the bottom 27 are two attachment points 30 where the ends of a strap are attached to the bag body (shown in FIG. 4). Similar to the slots 21, the two attachment points 30 are preferably substantially the same distance from the bottom 27 and are respectively disposed near the left and right sides 25, 26 of the bag body 2. In the illustrated embodiment, the distance D1 between the left slot 21 and the left attachment point 30 is the same as the distance between the right slot 21 and the right attachment point 30. Further, the distance D2 between the two slots 21 is the same as the distance between the attachment points 30.

The bag body 2 can be made from a variety of materials, including but not limited to, plastic, nylon, cotton, canvas, vinyl, leather or other cloth-like materials. In some embodiments, the bag body 2 can be made from a water resistant or water proof material. This makes the bag more convenient for users with more rugged requirements.

Figure 2:
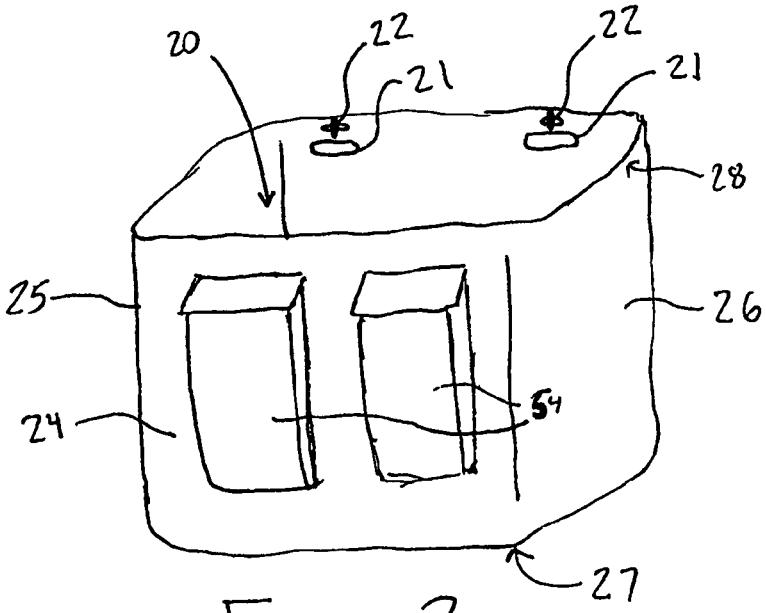
FIG. 2 is a front perspective view of the bag body of FIG. 1.

FIG. 2 shows the bag body 2 from the front. As shown, the front side 24 of the bag body 2 may include pockets 54 adapted to hold various items. The pockets 54 can have any known configuration and in the illustrated embodiment extend out from the bag body 2 and have flaps adapted to close the pockets 54.

Also shown in FIG. 2 are two fastening elements 22 disposed on the bag body 2 in the vicinity of the opening 28 at the top of the bag body 2. In the illustrated embodiment, the fastening elements 22 are disposed directly above the slots 21 on the inside 20 of the bag body 2. The fastening elements 22 are each a first portion of a fastening pair that are configured to attach to one another. Opposing portions of the fastener pair are included on the strap 3 which will be described in detail below. Accordingly, the fastening elements 22 on the bag body 2 are configured to attach to the corresponding fastening elements on the strap 3. Thus, for simplicity, the fastening elements on the bag body 2 will be referred to as primary fasteners 22 while the fastening elements on the strap will be referred to as secondary fasteners. The primary 22 and secondary fasteners can take on any form of fastener pair. For example, they may include buttons and buttonholes, male and female snaps, buckles, hook and loop attachments, grommets and grommet pins or other similar fastening elements. In the illustrated embodiment, the primary fasteners 22 are configured as clasps that are configured to pass through holes 31, 32 of the strap 3 and be held in place by twisting the clasps 22.

Figure 3:
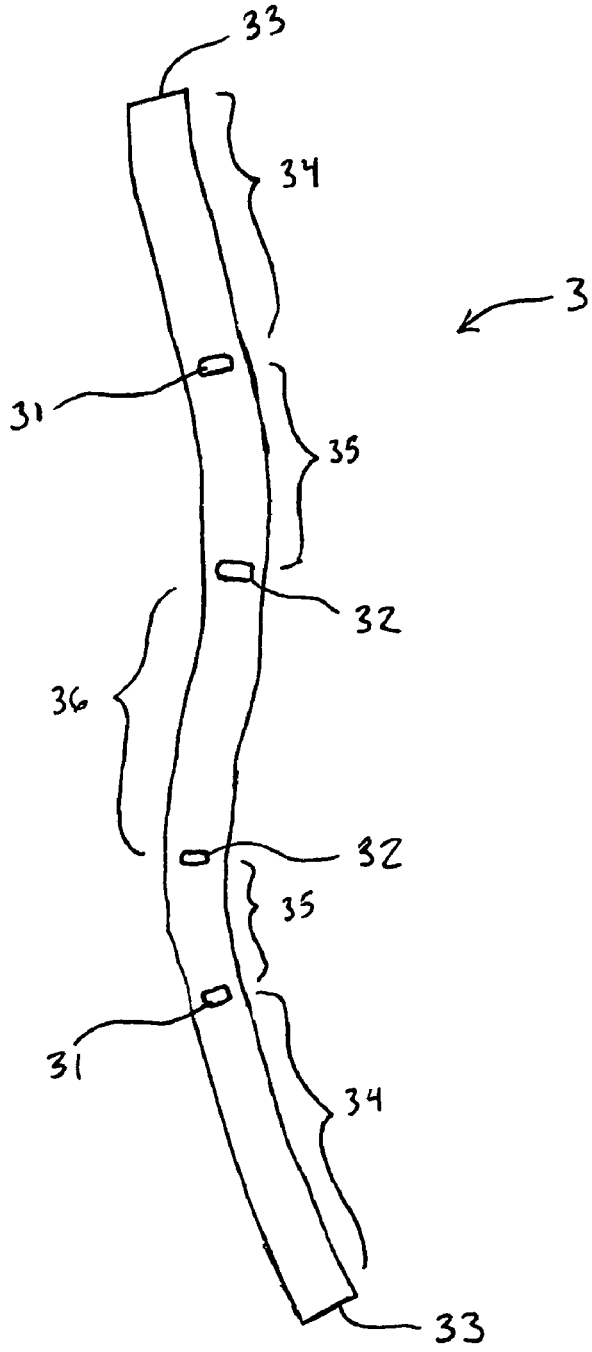
FIG. 3 shows an adjustable strap in accordance with an embodiment of the invention.

FIG. 3 shows an adjustable strap 3 in accordance with an embodiment of the invention for use with the bag body 2. The strap 3 includes two ends 33, an end section 34 adjacent each end 33, an extension section 35 adjacent each end section 34, and a middle section 36 between the extension sections 35. The strap 3 also includes secondary fasteners 31, 32 adapted to attach to the primary fasteners 22 of the bag body 2 so as to change the configuration of the strap. First secondary fasteners 31 are disposed between each end section 34 and the adjacent extension section 35. Further, second secondary fasteners 32 are disposed between each extension section 35 and the middle section 36. Thus, as shown in FIG. 3 the elements of the strap 3 along its length include: an end 33, an end section 34, a first secondary fastener 31, an extension section 35, a second secondary fastener 32, the middle section 36, the other second secondary fastener 32, the other extension section 35, the other first secondary fastener 31, the other end section 34 and the other end 33. As described in more detail below, the use of either the first secondary fasteners 31 or the second secondary fasteners 32 allow the bag to be switched between having a shoulder bag configuration and a backpack configuration, respectively.

The strap 3 can be made from a variety of different materials, including but not limited to, plastic, nylon, canvas, leather, vinyl or other cloth-like materials. In some embodiments, the strap 3 may include a padding therein which adds to the user's comfort when carrying the bag. The strap 3 may also be adjustable in length. If the length of the strap is adjustable, it is preferable that the strap 3 include two adjustment points, so that the length of each backpack strap can be varied. Preferably, the adjustment points would each be included in the extension sections 35 of the strap 3.

Figure 4:
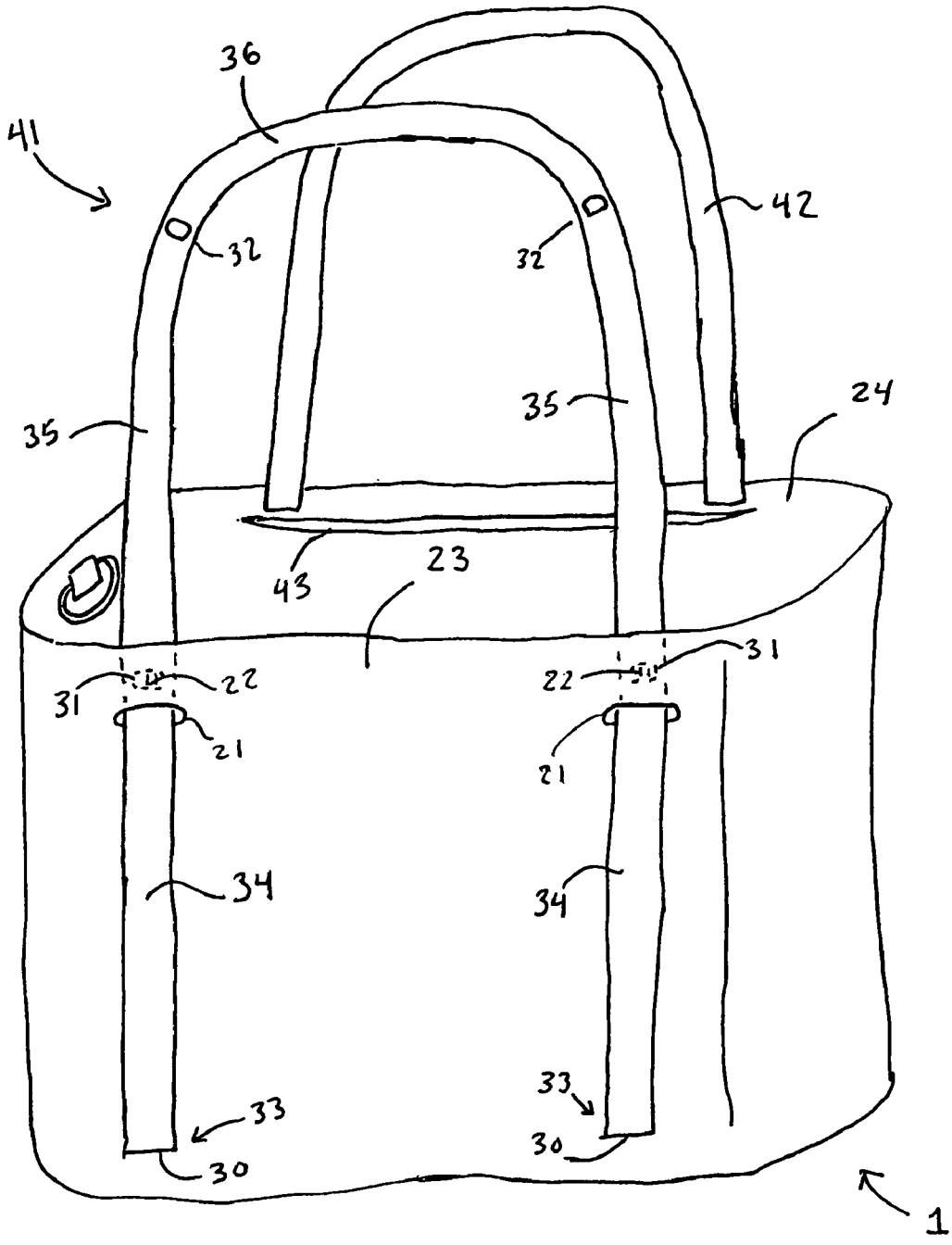
FIG. 4 shows a bag in accordance with an embodiment of the invention in a shoulder bag position.

FIG. 4 shows the bag 1 with the adjustable strap 3 fixed thereon and in the position for using the bag 1 as a shoulder bag. The ends 33 of the strap 3 are each attached to the respective attachment points 30 on the bag body 2 in the vicinity of the bottom of the bag body 2. The strap 3 is extending through each of the slots 21 with the ends 33 being disposed outside the slot 21 and the center of the strap being disposed on the inner side of the slot 21. Each of the first secondary fasteners 31 are attached to the primary fasteners 22. As a result, a long shoulder strap 41 is formed between the primary fasteners 22. The shoulder strap 41 includes the middle section 36 and each extension section 35 of the strap. In a preferred embodiment, the distance between each end 33 of the strap and the first secondary fastener 31 is substantially the same as distance D1 between the attachment point 30 and the respective primary fastener 22. This ensures that end sections 34 of the strap are taut when the strap 3 is in the shoulder strap position.

A second shoulder strap 42 is included on the front side 24 of the bag body 2. The second shoulder strap 42 allows the bag 1 to be used normally with a shoulder strap on each side. In one embodiment, the second shoulder strap 42 is attached to the front side 24 of the bag body 2 on the inside 20. This allows the second shoulder strap 42 to be tucked inside a pocket 43 inside the bag body when the bag 1 is not being used as a shoulder bag. Of course, the second strap 42 can be disposed on the outer side of front side 24 of the bag body 2. Likewise, it is not necessary that the slots 21 be included on the back side 23 of the bag body 2. Instead, the primary fasteners 22 can be included on the outer side of the back side 23 and the secondary fasteners 31, 32 can attach directly thereto.

Figure 5:
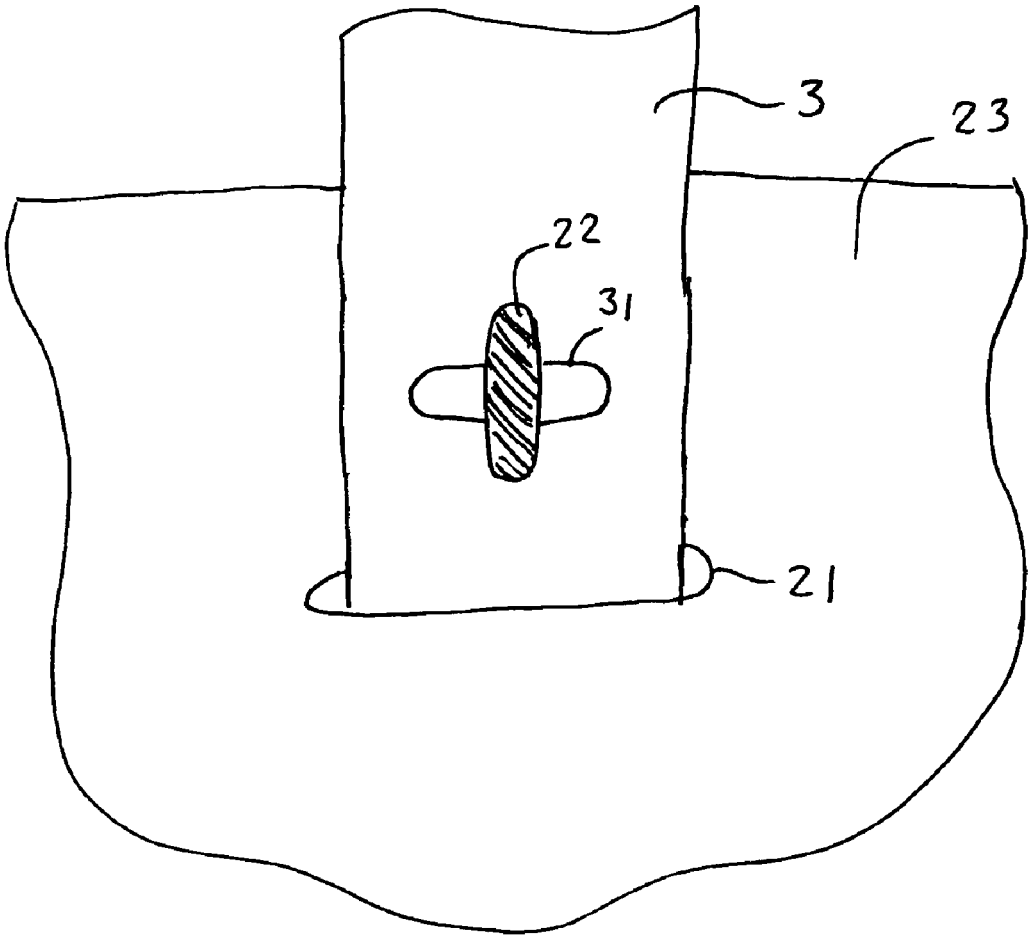
FIG. 5 shows a detail view of the fastener device used in the bag of FIG. 4 shown from inside the bag.

FIG. 5 shows a detailed view of the primary fastener 22 held in the first secondary fastener 31 of strap 3. As shown, the primary fastener 22 is a clasp and the first secondary fastener 31 is a slotted hole. To attach the clasp in the slotted hole, the clasp is inserted through the hole and twisted such that the clasp and slotted hole are perpendicular to one another. As a result, the clasp is held securely in the slotted hole. In this embodiment, the second secondary fastener 32 is similarly a slotted hole.

Figure 6:
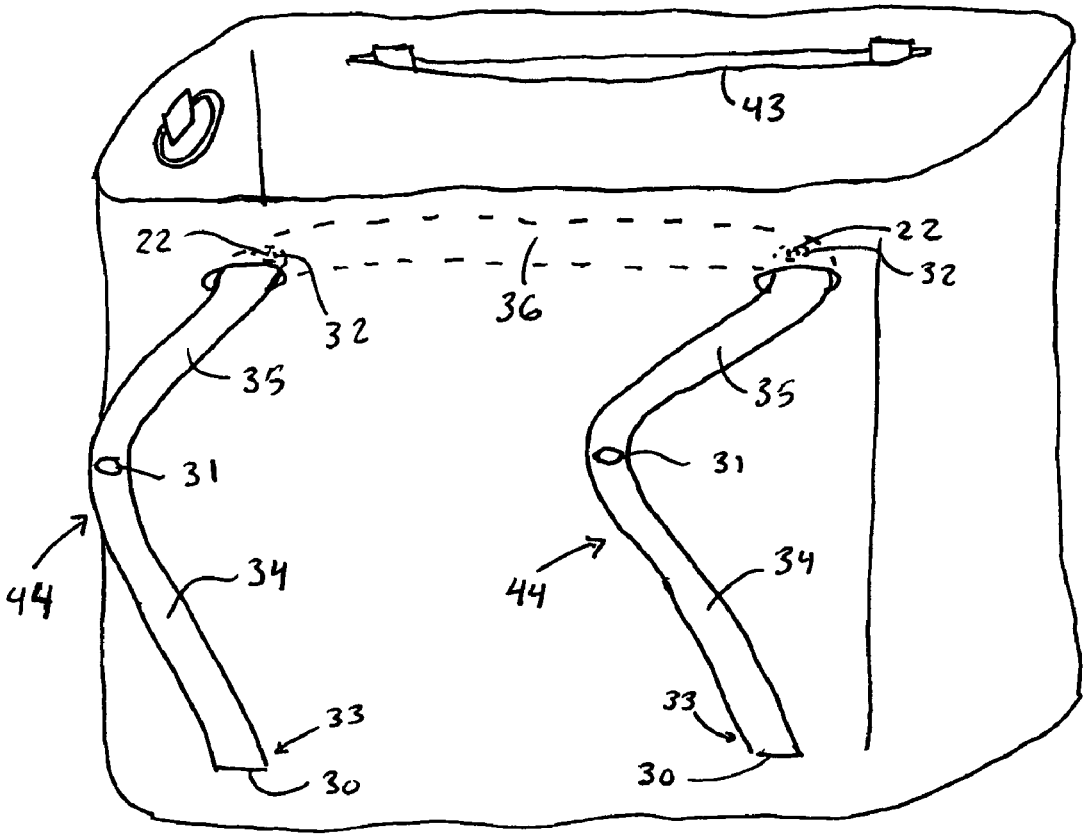
FIG. 6 shows the bag of FIG. 4 in a backpack position.

FIG. 6 shows the adjustable strap 3 in another position that forms two backpack straps 44. In this configuration the middle section 36 of the strap 3 stretches across the top of the bag body 2 and the second secondary fasteners 32 are attached to the primary fasteners 22. The extension sections 35 are then pulled through the slot 21 toward the outside of the bag to extend the length of the portions of the strap outside the bag 1. This forms the two backpack straps 44, each of which include an end section 34 and an extension section 35. Preferably, the length of the middle section 36 is substantially the same as the distance D2 between the slots 21 and primary fasteners 22. The second strap 42 is not visible in this figure, as it has been tucked away in pocket 43.

Figure 7:
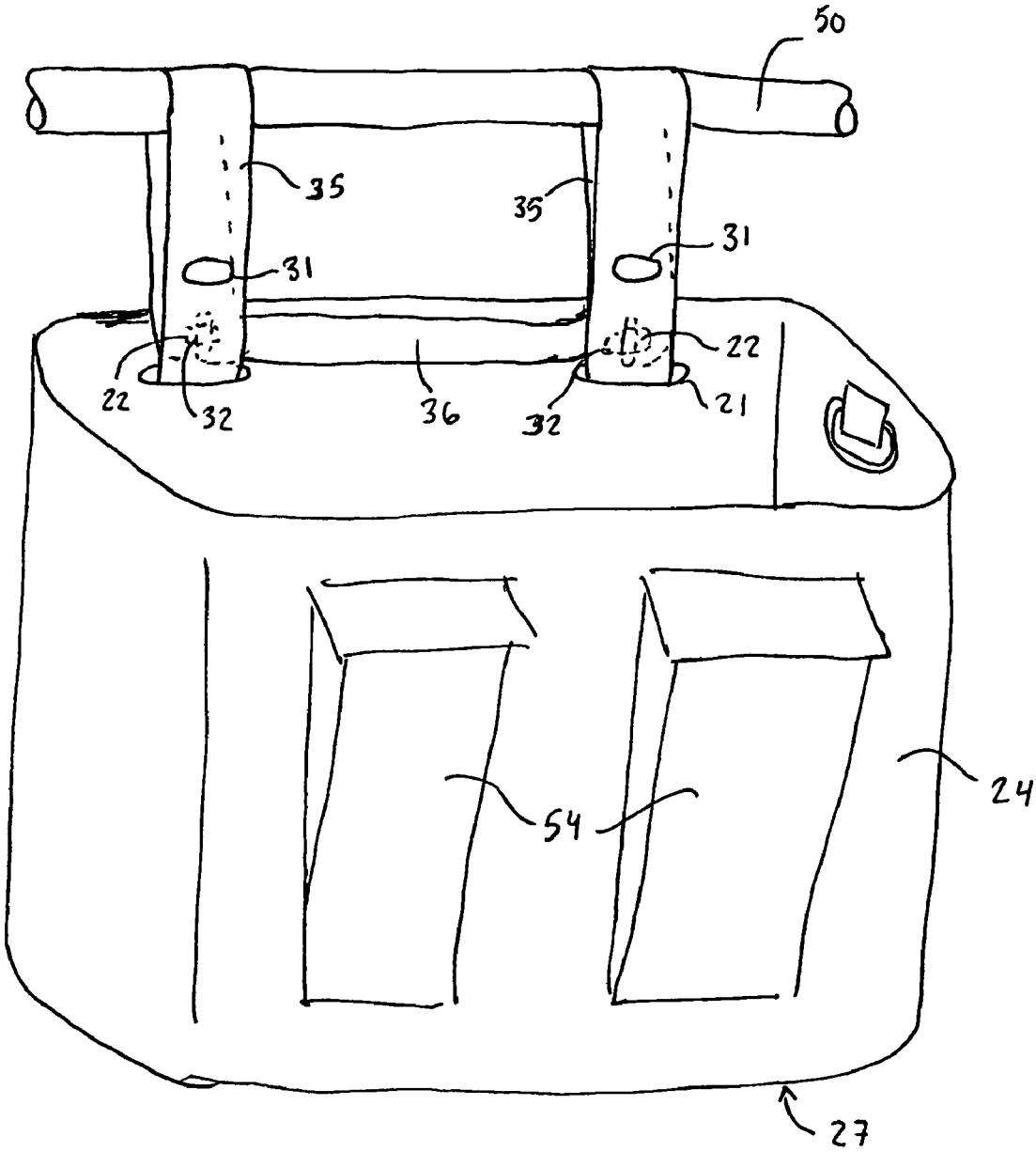
FIG. 7 shows the bag of FIG. 4 in an attachment position on a support bar.
Figure 8:
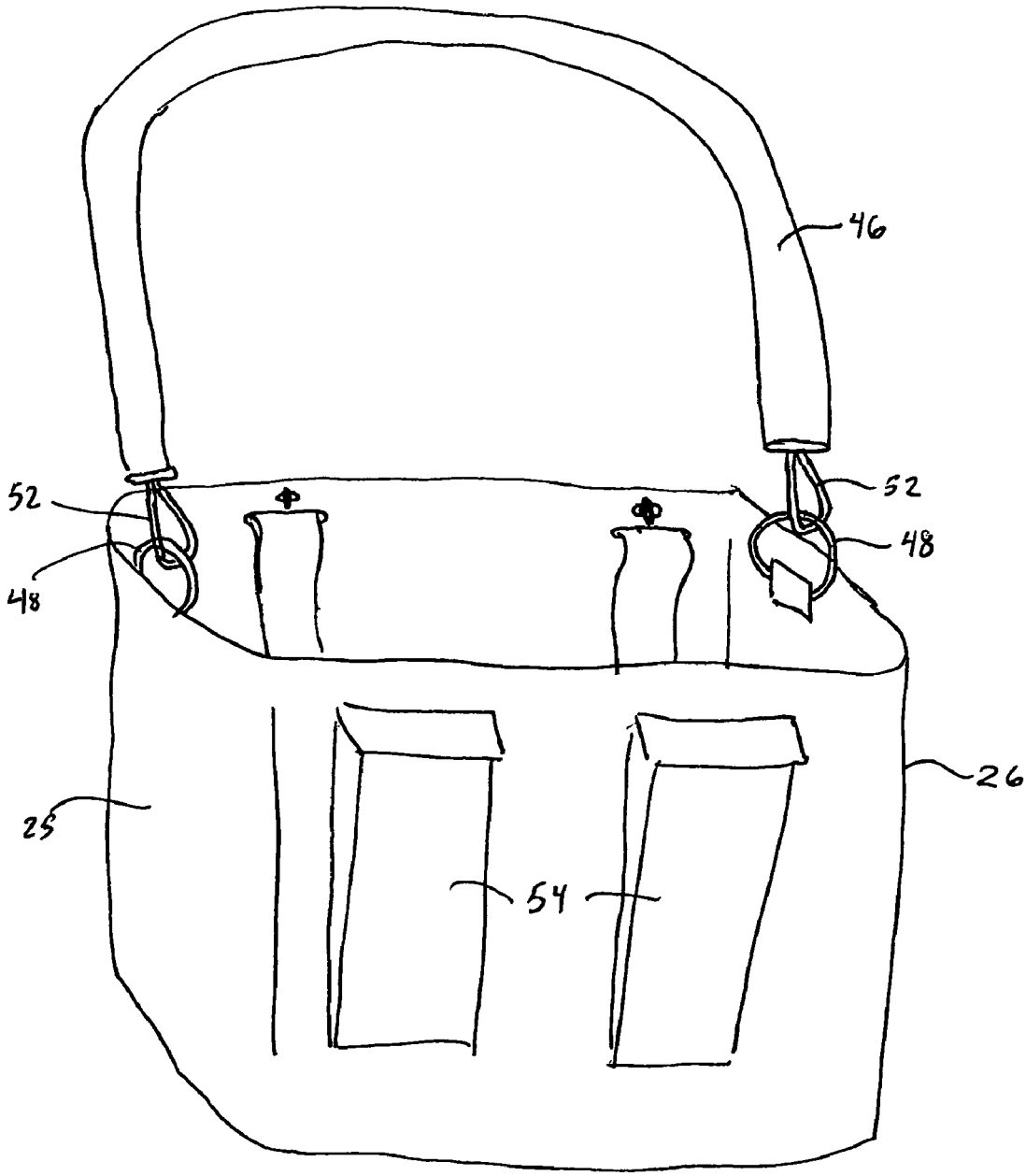
FIG. 8 shows the bag of FIG. 4 in a messenger bag position.

The adjustable strap 3 can also be configured to hold the bag 1 on a bar or support structure, as shown in FIG. 7. This makes the bag 1 especially suitable for parents as a diaper bag. In such a case, the adjustable strap 3 can be configured to be secured to the handle bar of a stroller. To secure the adjustable strap to the handle bar, the strap is pulled through slots 21 until the extension sections 35 are entirely on the inner side of the slots 21. The adjustable strap 3 is then pulled over the handle bar 50 and the middle section 36 is pulled down toward the bag body 2. Each of the second secondary fasteners 32 is then attached to the primary fasteners 22 and the middle section 36 is stretched across from one primary fastener to the other. The first primary fasteners 31 are left unattached.

The bag can also be configured to be carried as a messenger bag. In this configuration, a detachable shoulder strap 46 can be linked to the left and right sides 25, 26 of the bag body 2. The link the detachable shoulder strap 46 to the bag body, the strap 46 can include hooks 52 that are attachable to rings 48 which are permanently attached to the sides 25, 26 of the bag body. In one embodiment, the messenger bag strap 46 can be formed by the adjustable strap 3. In this embodiment, the ends 33 of adjustable strap 3 are detachably fixed to the bag body 2 at attachment points 30. Accordingly, the bag 1 can be held in four different positions using a single adjustable strap 3.

Figure 9:
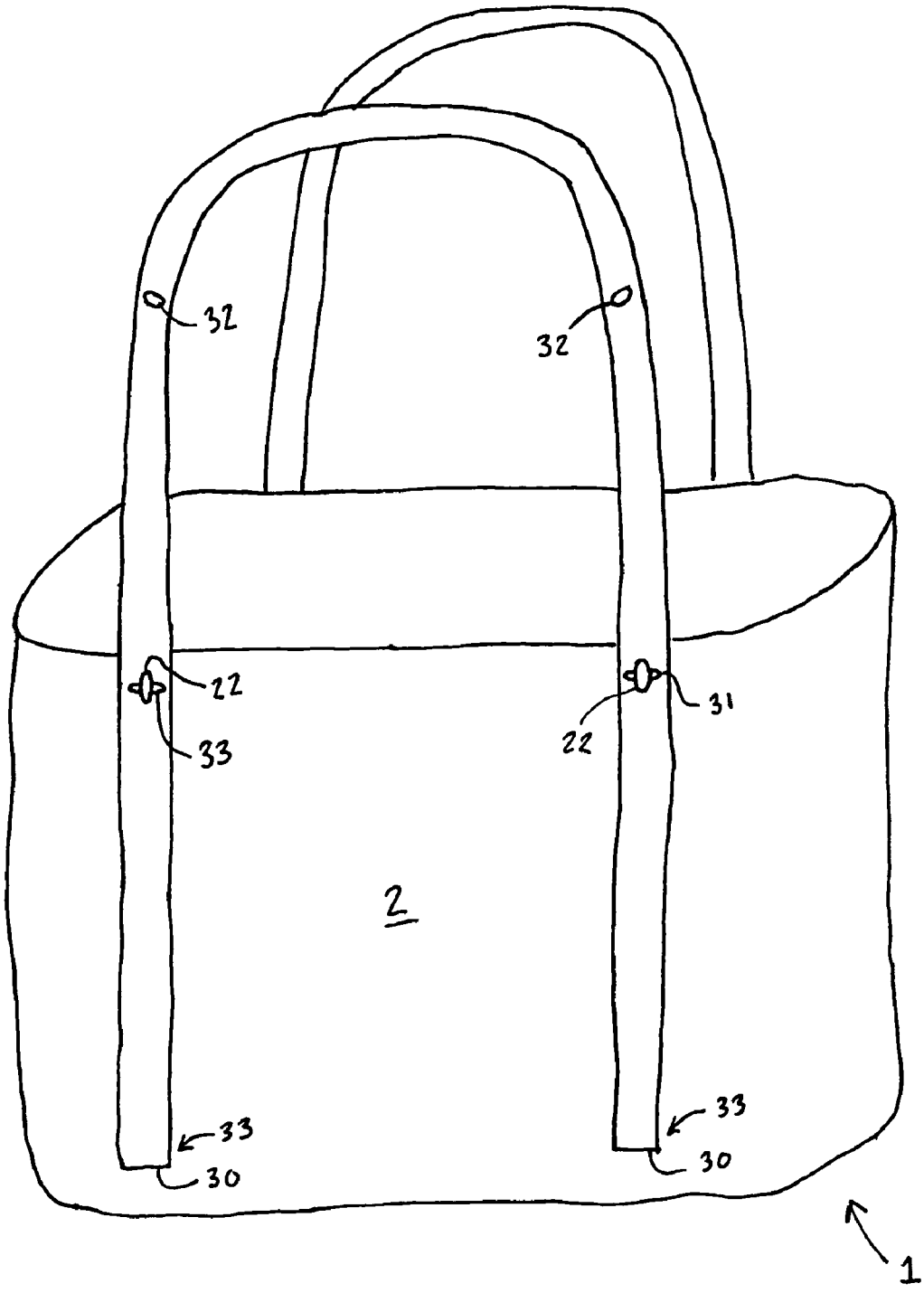
FIG. 9 shows a bag in accordance with another embodiment of the invention in a shoulder bag position.
Figure 10:
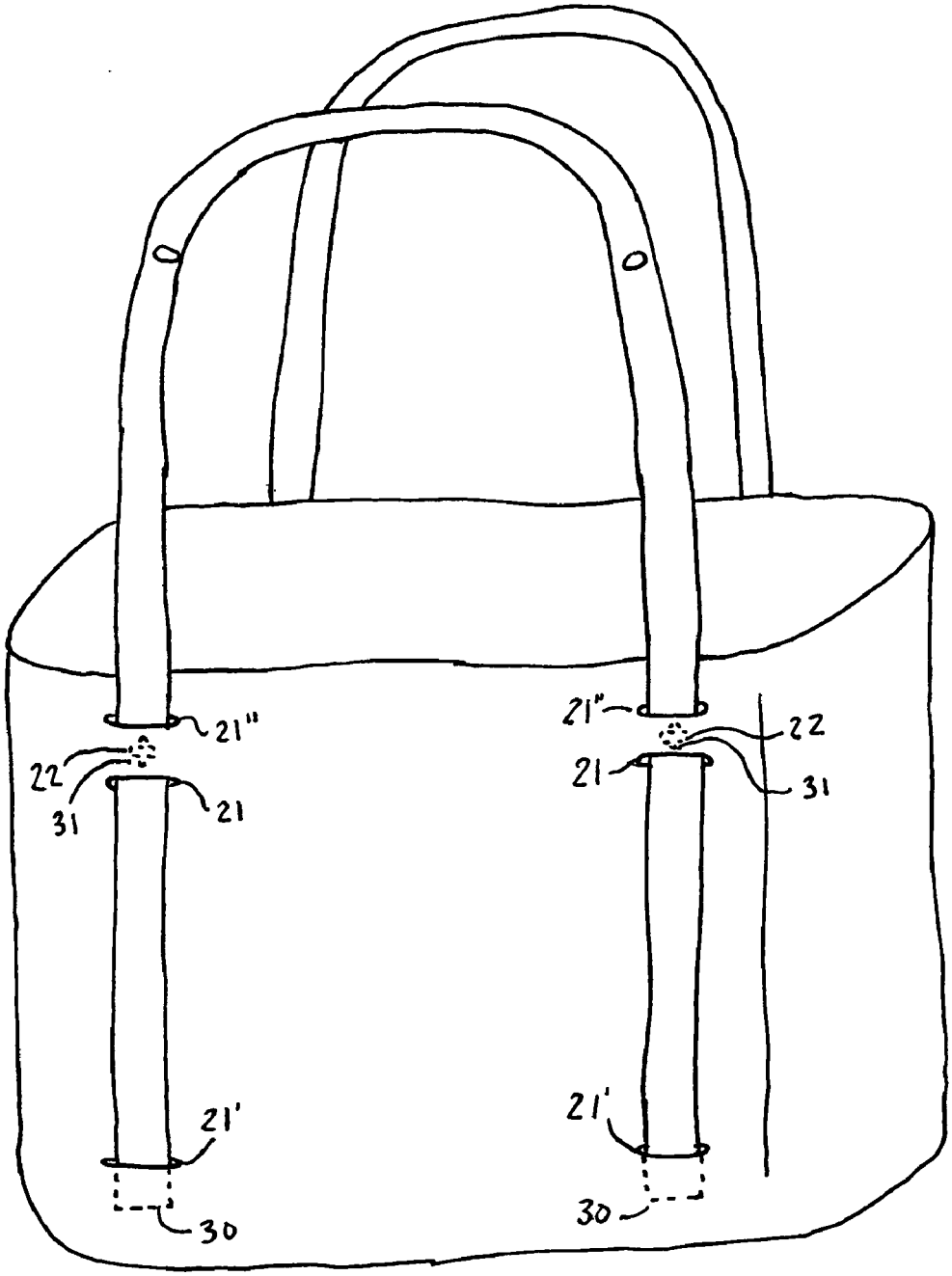
FIG. 10 shows a bag in accordance with yet another embodiment of the invention in a shoulder bag position.

FIGS. 9 and 10 show additional embodiments of the invention with different strap configurations from those described above. In the embodiment shown in FIG. 9, the straps are kept on the outside of the bag body 2. The primary fasteners 22 in this embodiment are positioned on the outside of the bag body 2 and the secondary fasteners 32, 33 each attach thereto on the outside of the bag. This embodiment simplifies construction. In other embodiments, such as that shown in FIG. 10, the bag 1 may include additional slots 21', 21" along with slot 21. Slots 21' and 21" allow the straps to have varying configurations with respect to their connection with the bag body 2. For example slots 21' allow attachment points 30 to connected to the bag on the inside of bag body 2. Further, slots 21" allow the straps to extend up from the top of the bag at the outside thereof, if such a configuration is desirable from an aesthetic perspective. Either of slots 21' and 21" could be used alone to obtain the above configurations and need not be used together. Moreover, these optional configurations can be used with any of the other features of the invention described above.

Dimensions, shapes, materials, and fastening types are noted above but are not intended to limit the invention. The present invention can be made in any combination of the above elements or by other substitutions known in the art.

We claim:

1. A bag with an adjustable strap, the bag comprising:

a bag body including a front side, a back side, a bottom and an opening opposite the bottom;

two primary fasteners disposed on the back side of the bag body in a vicinity of the opening;

an adjustable strap including:

two ends fixed to the back side of the bag body in a vicinity of the bottom, two end sections, each end section disposed adjacent a respective end of the adjustable strap, two first secondary fasteners, each first secondary fastener disposed adjacent a respective end section of the adjustable strap opposite the respective end, two extension sections, each extension section disposed adjacent a respective first secondary fastener opposite respective end sections, two second secondary fasteners, each second secondary disposed adjacent a respective extension section opposite respective first secondary fasteners, and a middle section disposed between the two second secondary fasteners, wherein the two first secondary fasteners are configured to respectively attach to the primary fasteners such that the middle section and extension sections of the adjustable strap form a long shoulder strap between the first secondary fasteners, and wherein the two second secondary fasteners are configured to respectively attach to the primary fasteners such each end section and respective extension section forms a backpack strap.

2. The bag of claim 1, wherein the two ends are fixed to the bag body at attachment points on an outer side of the bag body.

3. The bag of claim 2, wherein the bag body includes two slots, each slot being disposed below a respective primary fastener, and wherein the adjustable strap extends through each slot from the outer side of the bag body to an inner side of the bag body such that the middle section is disposed on an inside of the bag body.

4. The bag of claim 1, wherein a length of the middle section is substantially equal to a distance between the primary fasteners.

5. The bag of claim 2, wherein a length of each end section is substantially equal to a distance between an attachment point and a respective primary fastener.

6. The bag of claim 3, wherein a distance between the attachment points is substantially equal to a distance between the slots.

7. The bag of claim 1, wherein the adjustable strap is configured to secure the bag to a bar by looping the middle section over the bar and attaching the second secondary fasteners to respective primary fasteners.

8. The bag of claim 1, further comprising rings disposed on the right and left sides of the bag body configured to hold a messenger bag strap.

9. The bag of claim 1, wherein the primary fasteners are clasps and each of the first and second secondary fasteners are slotted holes.

10. The bag of claim 1 further comprising a second shoulder strap disposed on the front side of the bag body.

11. The bag of claim 1 further comprising at least one pocket disposed on the front side of the bag body.

* * * * *